United States Patent [19]

Smith

[11] Patent Number: 4,507,530

[45] Date of Patent: Mar. 26, 1985

[54] AUTOMATIC DEFROST SENSING ARRANGEMENT FOR MICROWAVE OVEN

[75] Inventor: Peter H. Smith, Anchorage, Ky.

[73] Assignee: General Electric Company, Louisville, Ky.

[21] Appl. No.: 523,178

[22] Filed: Aug. 15, 1983

[51] Int. Cl.[3] ..... H05B 6/08

[52] U.S. Cl. ..... 219/10.55 B; 219/10.55 F; 219/10.55 M; 324/58.5 C; 324/58 C

[58] Field of Search ..... 219/10.55 B, 10.55 F, 219/10.55 E, 10.55 M, 10.55 R; 426/241, 243, 523, 524; 99/DIG. 14; 324/58.5 C, 58.5 R, 58 C, 58 R

[56] References Cited

U.S. PATENT DOCUMENTS

| | | | |
|---|---|---|---|
| 3,460,031 | 8/1969 | Evans et al. | 324/58.5 |
| 3,813,918 | 6/1974 | Moe | 219/10.55 R X |
| 4,210,795 | 7/1980 | Lentz | 219/10.55 B |
| 4,303,818 | 12/1981 | Smith | 219/10.55 B |
| 4,341,937 | 7/1982 | Staats | 219/10.55 B X |

OTHER PUBLICATIONS

Patent Application Ser. No. 363,705, filed 3/30/82, Microwave Oven with Dual Feed Excitation System, in the names of Raymond L. Dills et al.

"A Non-Contact Temperature Monitor for the Automatic Control of Microwave Ovens", by R. G. Bosisio et al.-*Journal of Microwave Power*, Copyright 1977.

*Primary Examiner*—Philip H. Leung

*Attorney, Agent, or Firm*—H. Neil Houser; Redford M. Reams

[57] ABSTRACT

A system and method for defrost detection particularly applicable to a microwave oven having an excitation system which normally exhibits relatively little change in voltage standing wave ratio and phase for loads of widely varying dielectric constant values. A discontinuity is periodically introduced into the waveguide coupling microwave energy from the source to the cooking cavity. This discontinuity is effective to cause a substantial change in the magnitude and phase of the electromagnetic field in the waveguide for food objects in the frozen state, while causing relatively little change in these parameters for the same food objects in the thawed state. Hence, the presence of the discontinuity in the waveguide provides a readily detectable difference in field strength at the sensor location in the waveguide between an object in its frozen state and the same object in its thawed state. A sensor responsive to the strength of the electromagnetic field at a predetermined location in the waveguide generates an output signal representative of field strength at that location. This output signal is sampled with the discontinuity present in the waveguide to detect a predetermined relationship between the signal and a reference which when detected indicates the food load has converted from its frozen state to its thawed state.

8 Claims, 10 Drawing Figures

AUTOMATIC DEFROST SENSING ARRANGEMENT FOR MICROWAVE OVEN

BACKGROUND OF THE INVENTION

The present invention relates broadly to a system and method for defrosting frozen objects in a microwave oven. More specifically, the present invention relates to a system and method for distinguishing between the frozen state and the thawed state of an object being heated in the cooking cavity of a microwave oven to detect the transition from the frozen state to the thawed state, and using such information to control oven operation in a defrost operating mode.

It is well known in the art that the dielectric constant for water is substantially greater than that for ice to the extent that the response of the microwave excitation system to ice in the cooking cavity generally approaches that of a no-load condition. Since generally foods contain a large percent by weight of water, the dielectric constant for a food load in its thawed state is typically substantially higher than the dielectric constant for the same load in its frozen state. In many domestic microwave cooking oven designs in present use, the ratio of input power to reflected power back to the magnetron is sensitive to variations in the dielectric constant of the food load being heated in the oven. In such ovens, it is known to monitor the microwave input reflection coefficient in the oven to detect the change in reflection coefficient indicative of the beginning of the transition of the food load from its frozen state to its thawed state. One example of such a control system and method can be found in U.S. Pat. No. 4,210,795 to Lentz. In the Lentz system the magnetron power output level is switched from a high level to a low level upon detection of a reflection coefficient less than a predetermined reference value indicating that the food load in the oven has begun to thaw.

Such an approach works satisfactorily in those microwave ovens which are particularly sensitive to changes in the dielectric constant of the food object being heated. However, the cooking performance of a microwave oven would be greatly enhanced if operating parameters of the excitation system for the oven would be relatively insensitive to variations in dielectric characteristics of food loads heated therein. An example of one such oven is described in commonly assigned U.S. Pat. No. 4,458,126 to Dills et al. In the Dills et al oven during normal operation, changes in such magnetron operating parameters as the voltage standing wave ratio and the phase of the standing wave in the waveguide for foods in the frozen and thawed states, respectively, are relatively indistinguishable when sensed by a sensor in the waveguide. Hence, an arrangement such as that described in the Lentz patent would require a very high precision measurement system capable of resolving very small changes in the measured parameters.

From the foregoing, it is apparent that the more a microwave oven system is optimized to provide a relatively stable magnetron operating point for food loads over a wide range of dielectric constant values, the more difficult it becomes to distinguish the frozen state from the thawed state for foods being defrosted in the oven based upon the difference in the operating parameters measurable in the waveguide. It would be desirable, therefore, to provide a defrost detection system for such an oven, which system effectively distinguishes between thawed and frozen states of food objects heated therein as a function of the change in the dielectric constant as the food object converts from its frozen state to its thawed state.

It is therefore a primary object of the present invention to provide a method and a system for distinguishing between the frozen state and the thawed state of a food load being heated in the cavity for a microwave oven which in normal operation demonstrates relatively little variation in voltage standing wave ratio and phase for loads over a wide range of dielectric constant values, including ice and water.

SUMMARY OF THE INVENTION

The present invention provides a system and method for defrost detection particularly applicable to a microwave oven having an excitation system which normally exhibits relatively little change in voltage standing wave ratio and phase for loads of widely varying dielectric constant values. In accordance with the invention, means are provided for the periodic introduction of a discontinuity in the waveguide coupling microwave energy from the source to the cooking cavity. The discontinuity is effective to cause a substantial change in the magnitude and phase of the electromagnetic field in the waveguide for food objects in the frozen state, while causing relatively little change in these parameters for the same food objects in the thawed state. Hence, the presence of the discontinuity in the waveguide provides a readily detectable difference in field strength at the sensor location in the waveguide between an object in its frozen state and the same object in its thawed state.

Sensing means responsive to the strength of the electromagnetic field at a predetermined location in the waveguide generates an output signal representative of field strength at that location. Defrost detection means sample the output signal from the sensing means while said discontinuity is present in the waveguide to detect a predetermined relationship between the signal and a reference which when detected indicates the food load has converted from its frozen state to its thawed state. The periodic introduction of the discontinuity temporarily transforms the excitation system to a modified system which is particularly sensitive to the difference in the dielectric constant of loads in the frozen state relative to loads in the thawed state to the extent that difference in phase and the voltage standing wave ratio between the frozen and thawed states of the food load are readily resolvable without resort to costly high precision sensing circuitry.

BRIEF DESCRIPTION OF THE DRAWINGS

While the novel features of the invention are set forth with particularity in the appended claims, the invention both as to organization and content will be better understood and appreciated from the following detailed description, taken in conjunction with the drawings in which:

DETAILED DESCRIPTION

Figure 1:
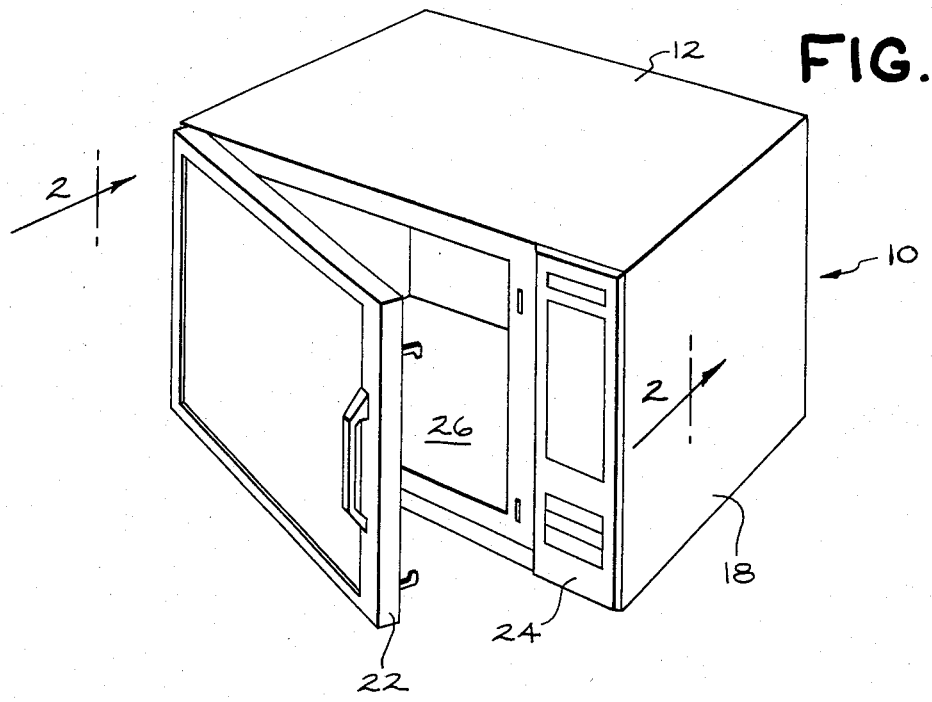
FIG. 1 is a front perspective view of a microwave oven.
Figure 2:
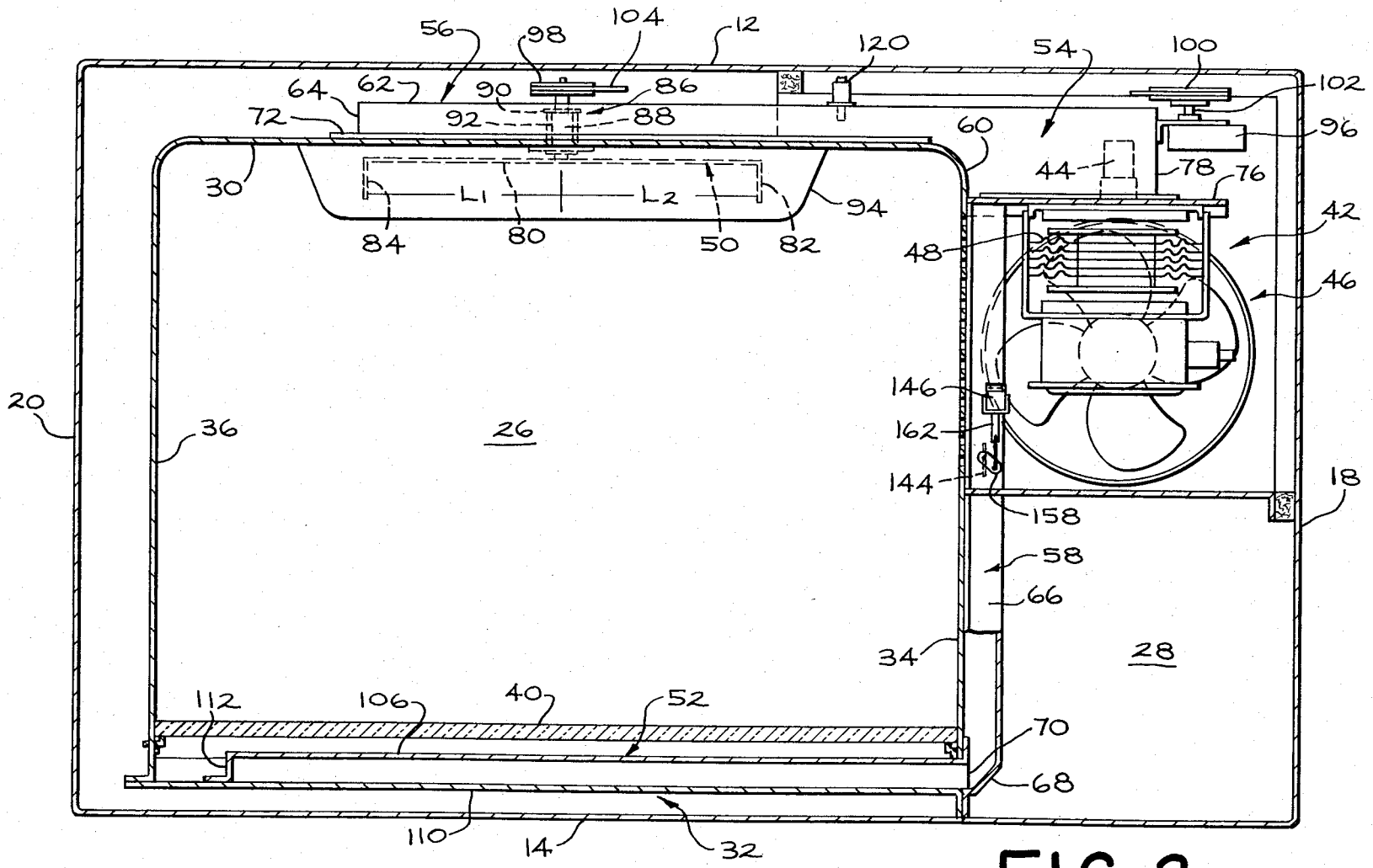
FIG. 2 is a front schematic sectional view of the microwave oven of FIG. 1 taken along line 2—2.
Figure 3:
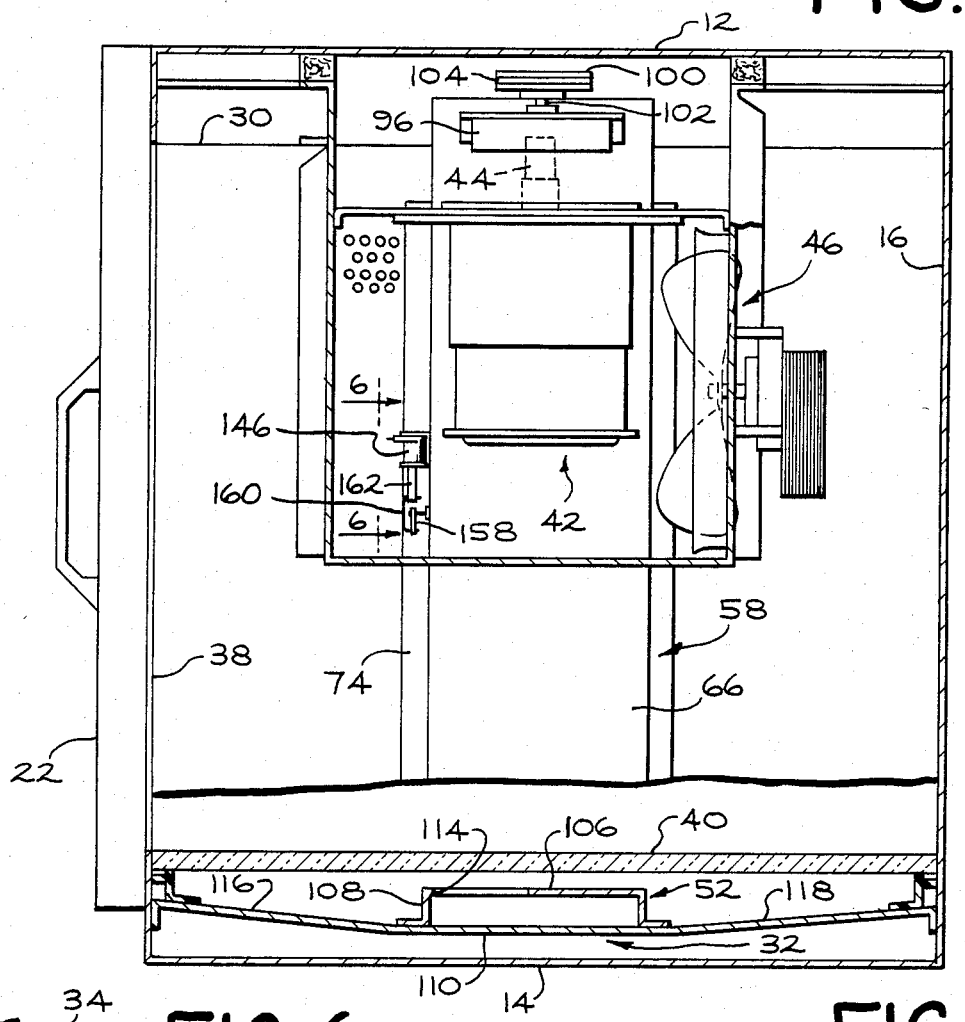
FIG. 3 is a schematic side view partially in section of the microwave oven of FIG. 1 with portions removed to illustrate details of the illustrative embodiment of the present invention.

Referring now to FIGS. 1–3, there is shown a microwave oven designated generally 10. The outer cabinet comprises six cabinet walls including upper and lower walls 12 and 14, a rear wall 16, two side walls 18 and 20, and a front wall partly formed by hingedly supported door 22 and partly by control panel 24. The space inside the outer cabinet is divided generally into a cooking cavity 26 and a controls compartment 28. The cooking cavity 26 includes upper wall 30, a bottom wall 32, side walls 34 and 36, the rear cavity wall being cabinet wall 16 and the front cavity wall being defined by the inner-face 38 of door 22. Nominal dimensions of cavity 26 are 16 inches wide by 13.67 inches high by 13.38 inches deep. The support plate 40 of microwave pervious dielectric material such as that commercially available under the trademarks PYROCERAM or NEOCERAM is disposed in cavity 26 substantially parallel to bottom cabinet wall 14.

Controls compartment 28 has mounted therein a magnetron 42 which is adapted to produce microwave energy having a center frequency of approximately 2450 MHz at output probe 44 thereof when coupled to a suitable source of power (not shown) such as the 120 volt AC power supply typically available at domestic wall receptacles. In connection with the magnetron 42, a blower designated generally 46 provides cooling airflow for channeling airflow over the magnetron cooling fins 48. The front facing opening of the controls compartment 28 is enclosed by control panel 24. It will be understood that numerous other components are required in a complete microwave oven, but for clarity of illustration and description only those elements believed essential for a proper understanding of the present invention are shown and described. Such other elements may all be conventional and as such are well known to those skilled in the art.

The excitation system for oven 10 is a dual feed system having a rotating antenna 50 supported from top cavity wall 30 and a slotted radiating chamber 52 extending centrally along the bottom wall 32 of cavity 26.

The source of microwave energy for the excitation system of oven 10 is magnetron 42. Microwave energy from magnetron output probe 44 of magnetron 42 is coupled to the antenna 50 and the slotted waveguide 52, respectively, by waveguide means comprising a central section 54 which houses magnetron output probe 44, a first section 56 extending generally centrally along the upper cavity wall 30 to couple energy from probe 44 to antenna 50 and a second section 58 running in a vertical direction generally centrally along cavity side wall 34 to couple energy from probe 44 to chamber 52. A rounded step 60 formed at the junction of first and second sections 56 and 58, respectively, divides the power from magnetron 42 between these sections, matches the impedance of the system to the magnetron, and facilitates excitation of the antenna 50 and the slotted chamber 52 in phase.

Waveguide section 56 is of generally rectangular cross section and generally formed by member 62 of generally U-shaped cross section and top cavity wall 30. End wall 64 of section 56 provides a short circuit termination for section 56. Second waveguide section 58 is also of generally rectangular cross section being generally formed by member 66 of U-shaped cross section and side wall 34. The end wall 68 of section 58 remote from magnetron 42 forms a standard 45 degree transition bend to guide energy propagated in section 58 to opening 70 which opens into radiating chamber 52. The 45 degree bend provides a low loss transition with no phase change nor power dissipation. Both sections are dimensioned to support a $TE_{10}$ propagating mode. Specifically, the width (the dimension running front to rear of the cavity) is more than one-half but less than one guide wave lengths and the height is less than one-half guide wave length. The height of sections 56 and 58 is nominally 0.75 inches and the width is nominally 3.6 inches.

Central waveguide section 54 is a generally rectangular enclosure which is formed on top and sides by extension of member 62 beyond cavity 26 and on the bottom by support flange 76. Section 54 serves as a launching area for microwave energy radiated from magnetron probe 44 enclosed therein. Conductive end wall 78, spaced approximately $\frac{3}{4}$ inch from probe 44, provides a short circuit waveguide termination. The spacing is in accordance with magnetron manufacturer recommendations for proper operating characteristics. Section 54 is of the same width as sections 56 and 58 but of significantly greater height (on the order of two inches) with an open end facing the rounded step 60 formed at the intersection of side wall 34 and top wall 30.

Energy radiated from probe 44 within central section 54 propagates to the vicinity of step 60 where sections 56 and 58 join section 54. At this juncture, the energy splits with a first portion propagating in the first section 56 and a second portion propagating in the second section 58, the fraction of the total energy apportioned to each being a function of the impedance presented to the magnetron at the entrance to each section. It is believed that the curve step at 60 (radius of curvature nominally 0.64 inches) forms a junction which renders the sending impedance for both sections 56 and 58 more sensitive to antenna and food load impedance variations than would be the case with a more conventional bifurcator or power divider of the type projecting sharply into the junction region for power splitting.

Antenna 50 comprises a center fed microwave strip line 80 extending substantially parallel to top cavity wall 30 vertically spaced from top wall 30 by a nominal distance of $\frac{1}{4}$ inch (approximately 0.05 free space wavelengths). Strip line member 80 is terminated at each end by vertical radiating members 82 and 84 which extend in a direction away from top wall 30 at an angle to strip line 80 to provide predominantly TM mode excitation in the cavity. As the antenna rotates, it passes through positions of optimum coupling of certain modes in the cavity. In oven 10, members 82 and 84 extend at a angle of 90 degrees relative to strip line member 80.

Strip line member 80 and radiating members 82 and 84 are formed from a metallic strip preferably of approximately ½ inch (0.1 free space wavelength) in width and approximately 0.025 inches (0.006 free space wavelengths) in thickness. The length of each of radiating members 82 and 84, respectively, is nominally one inch (slightly less than ¼ free space wavelength). Dimensions L1 and L2 are preferably selected equal so that the radiating members 82 and 84 are fed in time phase with each other. The length for L1 and L2 in oven 10 is a nominal length of four inches (approximately ⅞ free space wavelengths) to provide the desired impedance match for radiating members 82 and 84. Energy from waveguide section 56 is coupled to strip line member 80 by conductive metallic antenna probe 86. Antenna probe 86 includes a cylindrical portion 88 terminating at one end in an impedance matching capacitive cap 90 which extends into the interior of waveguide section 56 for coupling therewith. Probe 86 is located at an integral multiple of 1/6 guide wavelengths from end wall 64 of guide section 56 for tight coupling in accordance with known design practice to contribute to the desired high sending impedance at the entrance to section 56. Waveguide section 56 extends a distance of 4/6 guide wavelengths beyond probe 86 to provide structural support to top cavity wall 30. The extent of penetration by probe 86 into guide section 56 is adjusted to provide the desired coupling. The maximum extent being limited by requirement for sufficient clearance between cap section 90 and upper wall 68 of guide section 64 to prevent arcing. In the illustrative embodiment, this gap is nominally set at 0.12 inches. Capacitive cap 90 provides the desired equivalent electrical length for probe 86 for good impedance matching and coupling of energy from waveguide 56. Probe 86 is rotatably supported in top cavity wall 28 by a dielectric bushing 92. A microwave energy transparent antenna cover 94 of truncated conical configuration is provided to enclose the antenna 50 to protect it from mechanical interference with items placed in cavity 24 and to keep it clean.

Antenna 50 is rotated by electric motor 96 which is drivingly coupled to antenna 50 by a pulley and belt arrangement including pulley 98 supported from antenna probe 86 and pulley 100 supported from drive shaft 102 of motor 96. Pulleys 98 and 100 are drivingly coupled by drive belt 104.

Microwave energy is coupled to the lower region of cavity 26 by rectangular radiating chamber 52 which extends centrally along the bottom wall of cavity 24. Chamber 52 is formed by a channel member of generally U-shaped cross section having a top wall 106 and integral side walls 108. The U-shaped memhnr is suitably secured to a flat central section 110 of the bottom wall 32 of cavity 26, such as by welding. Energy from waveguide section 58 enters chamber 52 through open end 70. Chamber 52 is terminated at its opposite end by end wall 112 which provides a short circuit termination for chamber 52. The height and width dimensions of chamber 52 are chosen in the conventional manner hereinbefore described with reference to waveguide sections 56 and 58 to support a $TE_{10}$ mode varying with the width being as thin as those sections and the height being nominally 0.79 inches. Chamber 52 extends across a substantial portion of cavity 26 so as to provide the desired energy distribution pattern. However, the exact length thereof is chosen to provide the proper impedance back to the entry port of waveguide section 58.

Top wall 106 of chamber 52 has formed therein an array of radiating slots 114 arranged to establish a particular substantially stationary radiation pattern in the cavity 26. Specifically, the slots are arranged to provide a radiating pattern which provides cooking regions of relatively high energy density which fill in areas of the antenna radiating pattern of relatively low energy density. Each of radiating slots 114 is constructed as a non-resonant slot, that is, the longitudinal axis of the slot is oriented crosswise to the direction of propagation in chamber 52. The dimensions of the slots are chosen to be evenly distributing the energy along the radiating chamber and to provide the desired impedance matching. Specifically, slot length is chosen at less than one-half the guide wavelength so as to provide non-resonant slots. This assures that energy is relatively evenly distributed along the length of chamber 52 rather than radiating from those slots nearest the entrance of the chamber.

As hereinbefore described, support plate 40 is disposed in cavity 26 for supporting food items to be heated in the cavity. The spacing of plate 40 above chamber 52 is selected for desired impedance matching. This spacing significantly affects energy intensity at the bottom of food loads supported on plate 40. A nominal spacing of approximately 0.18 inches was selected for the oven of FIG. 10 to provide satisfactory performance for a wide range of typical food load sizes. Support plate 40 also serves as a refracting member for energy radiated from radiating chamber 52 as well as energy reflected from bottom cavity wall 32. The refracting function of plate 40 tends to laterally spread the energy radiating pattern radiated from slots 114 to more widely distribute this energy in cavity 26.

Bottom wall 32 of the oven cavity has surfaces 116 and 118 which are bent or sloped upwardly from flat central section 110 to the front and rear walls, respectively, of the cavity. These surfaces operate primarily to reflect microwave energy from the antenna 50 upwardly and centrally toward the food to be heated which is usually located in the central portion of the oven. To this end, the reflective surfaces are bent upwardly at an angle to the horizontal of between three and fourteen degrees. The exact angle is chosen based on various parameters such as dielectric constants of typical foods to be cooked in the oven and its location in the oven cavity. In oven 10, this angle is about 8 degrees to the horizontal.

It has been empirically determined that for most food loads satisfactory cooking performance for the dual feed system of the oven of FIG. 1 is achieved when more power is radiated from the top than from the bottom. Thus, in designing the excitation system for oven 10, those parameters bearing on the impedance presented at the entrance to each waveguide section such as guide wave lengths, antenna parameters, and slot configurations, have been selected in accordance with standard design practices to provide impedance matching which results in greater apportionment of the energy from the magnetron being coupled to antenna 50. In oven 10, these parameters are selected to provide a high impedance at both points with the relative impedance being balanced to provide a nominal power spread of 50–75 percent of the total power going to section 56 for most loads.

As hereinbefore briefly described, the energy delivered to the central waveguide section 54 from magnetron 42 is split between waveguide sections 56 and 58 as a function of the impedance presented by the junction of each with central section 54. The impedance presented to magnetron 42 by antenna 80 at the entry port of guide section 56 varies with time as the antenna rotates. The initial impedance presented by slotted chamber 52 at the entry port for the guide section 58 at the beginning of the cooking cycle is a function of the food load parameters, the size, dielectric constant, etc. In addition, as the food cooks, certain parameters such as the dielectric constant change, altering the impedances at both entry ports, but particularly at the entry port to the second section as seen by magnetron 42. Hence, the fractional apportionment of energy to the guide sections 56 and 58 varies as the impedances presented at their respective entry ports change and thus adapt initially to the food load and also changes as the food load characteristics change during the cooking process.

Additional details as to the structure and manner of operation of oven 10 may be found in commonly-assigned, U.S. Pat. No. 4,458,126, entitled, "Microwave Oven With Dual Feed Excitation System," mentioned briefly in the Background discussion, the specification of which is hereby incorporated by reference.

As discussed briefly in the Background section, it is an object of the present invention to provide a system and method for implementing a defrost mode in such a microwave oven. In a satisfactory defrost mode, a frozen food load is converted from a frozen state in which the food object is essentially a solid or brittle unworkable mass to a thawed state in which the food object is sufficiently thawed to be malleable or pliable enough for manipulations typically associated with food preparation such as forming ground meat patties or meat balls, or having centers that could be pierced or broken apart with a fork but not sufficiently heated to begin actual cooking of the food object. Hence, for purposes of the description to follow, the terms "frozen state" and "thawed state" will be understood to connote the following characteristics of the food object to which the terms are applied. An object is considered to be in its frozen state when it is essentially of solid or hard consistency, typically at a temperature of less than 15° F. An object is considered in its thawed state when sufficiently malleable or pliable to enable manipulation for food preparation and typically at a temperature in excess of 25° F. For example, a 2-lb. mass of hamburger in its frozen state will be a single solid unworkable mass. In its thawed state, the user will be able to readily break the mass into smaller pieces. Ice particles may be present in the mass, but the meat will be sufficiently thawed to be hand workable. For different types of foods, the temperature of the food object in each state may be different; hence, a workable consistency rather than an actual temperature of the food object is the characteristic of primary concern when defrosting objects in a microwave oven.

Figure 4:
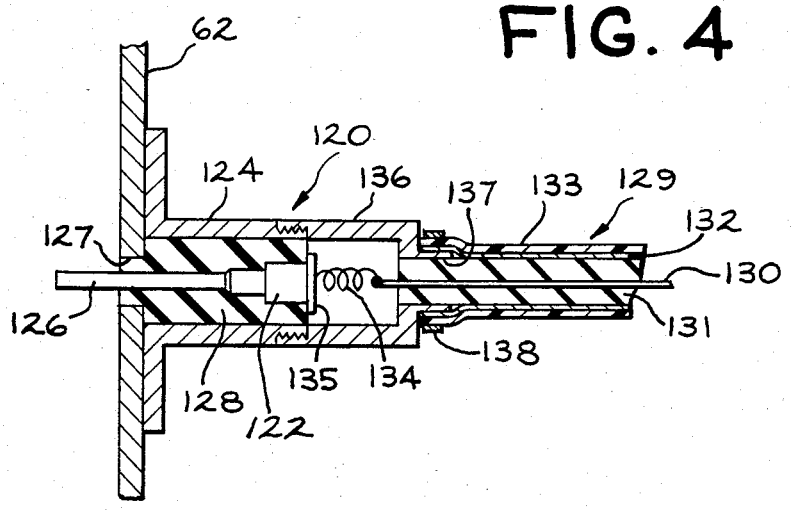
FIG. 4 is an enlarged view of the detector shown in FIG. 2 mounted in a section of the waveguide for making electrical field strength in the waveguide of the oven.

In accordance with the present invention, the transition of a food item from its frozen state to its thawed state is detected by monitoring the field strength in the waveguide. To this end, a crystal field detector 120 is mounted to waveguide section 56. As best seen in FIG. 4, detector 120 comprises a crystal detector 122 supported in a generally cylindrical, base support member 124 suitably secured to waveguide wall 62. Crystal 122 detector may be a standard crystal detector such as that commercially available and identifiable by the designator IN 32. A probe 126 extends from crystal 122 detector into the interior of waveguide section 56 through aperture 127 formed in waveguide wall 62. Probe 126 and crystal 122 detector are enclosed within base member 124 by a dielectric sleeve 128. Crystal 122 detector is electrically coupled to the control circuitry via coaxial cable 129, comprising an inner conductor 130; a dielectric core 131 surrounding inner conductor 130, a conductive shield layer 122 and a protective dielectric outer layer 133 of a polyvinyl chloride material or similar material. A conductive spring member 134 is secured at one end to inner conductor 130. The opposite end engages contact surface 135 of crystal 122 detector. When fully assembled, spring member 134 is compressed between conductor 130 and contact surface 135 to insure good electrical contact with crystal 122 detector. A generally cylindrical coupling member 136 for connecting coaxial cable 129 to detector 120 is connected to cable 129 at its annular neck portion 137 of reduced diameter. The inner conductor 130 and dielectric core 131 of coaxial cable 129 are received within neck portion 137 with the shielding layer 132 and outer protective layer 133 extending over the exterior of neck portion 137. A ring clamp 138 secures these layers to the neck. The opposite end of coupling member 136 is threaded onto base member 124. The electromagnetic field in waveguide 56 produces a voltage in the probe of the field detector proportional to and representative of field strength in the guide at the probe.

The design of oven 10 is such that during normal operations the field strength sensed by detector 120 will show relatively little difference between a given food load in its frozen state and in its thawed state. Hence, in its normal operation it would be difficult to reliably identify the transition from the frozen state to the thawed state.

Figure 5:
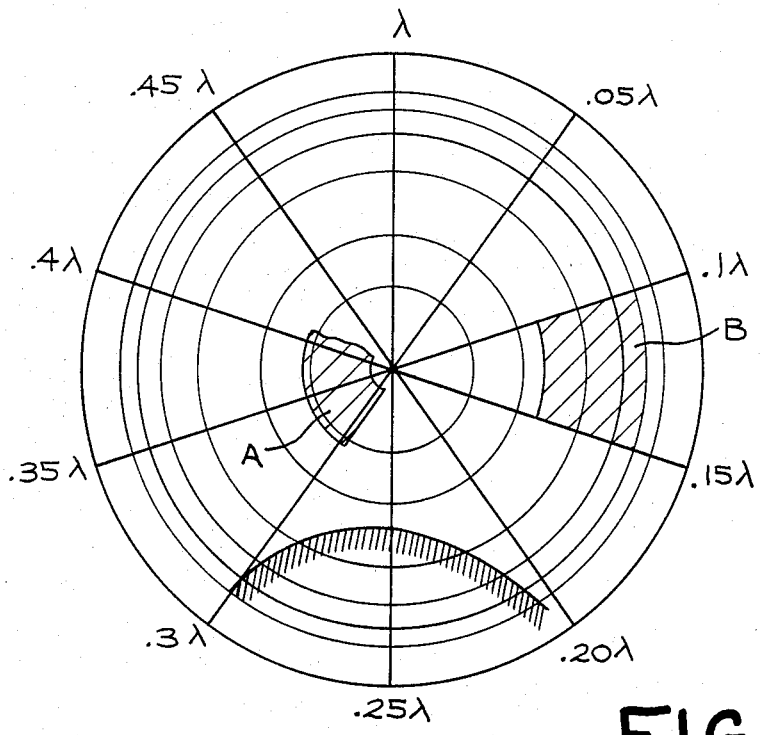
FIG. 5 is a Rieke diagram for the excitation system of the oven of FIG. 1 showing the operating region for the magnetron under different load conditions.

The Rieke diagram of FIG. 5 illustrates the operating characteristics of the excitation system of oven 10 in terms of the performance characteristics of magnetron 42. The performance characteristics of a magnetron such as output power and operating frequency depend on the load presented to the magnetron comprising the waveguide, the cavity and objects placed in the cavity. The Rieke diagram of FIG. 5 is a polar plot, the coordinates of which express load impedance in terms of phase and magnitude of the reflection coefficient at the magnetron probe.

The Rieke diagram includes an arrangement of concentric circles which indicate the reflection factor or voltage standing wave ratio (VSWR); the center indicating a VSWR of 1, and the progressively larger circles indicating higher VSWR's as shown. A series of straight lines radiate from the center calibrated in fractional wavelengths as indicated on the perimeter of the chart, indicating the phase position of the first minimum of the electric field relative to the magnetron probe.

During normal operation of oven 10, the operating point for substantially all typical food loads, thawed or frozen, heated in cavity 26 lies in the crosshatched region designated A, corresponding to standing wave ratios in the range of 1.1 to 1.6 with relative phase of 0.30 to 0.40 guide wavelengths. In normal operation, a given food load both in its frozen state and in its thawed state would have an operating point in this region. Hence, it would be very difficult to reliably distinguish between frozen and thawed states by monitoring field characteristics in the waveguide when operating in this mode.

In accordance with the present invention, this difficulty is overcome by periodically introducing a discontinuity into the waveguide and sampling the field strength detected by detector 120 with the discontinuity present in the waveguide. It has been empirically determined that in the oven of FIG. 1 a discontinuity may be located in waveguide section 58 which introduces a significant difference in both the standing wave ratio and the phase of the standing wave in waveguide section 56 for.a food object in its frozen state relative to that same food object in its thawed state. This discontinuity in effect significantly shifts the operating point of the excitation system on the Rieke diagram (FIG. 5) for a food object in its frozen state relative to that for the same food object in its thawed state. In oven 10, the operating point for thawed food objects is relatively unaffected by the introduction of the discontinuity. However, for frozen food objects both the magnitude of the VSWR and the phase of the standing wave are substantially altered, introducing a readily detectable difference in field strength at the sensor between frozen and thawed state. More particularly, when the discontinuity is introduced into waveguide, the operating point for a frozen food load falls in the crosshatched region designated B in FIG. 5, while the operating point for the same load in its thawed state continues to lie in Region A. Region B is characterized by standing wave ratios on the order of 1.75 to 5 and phase angles on the order of 0.10 to 0.15 guide wavelengths. The introduction of the discontinuity in effect forces a phase shift for the field in the waveguide on the order of one quarter guide wavelength for a food load in its frozen state relative to its thawed state. Hence, by locating a sensor at a position along the waveguide where the field strength is a maximum for a frozen food load with the discontinuity present, field strength at that location for the same food load in its thawed state will be a relative minimum, rendering the transition from frozen state to thawed state readily detectable without need to resort to high resolution sensing devices.

Figure 6:
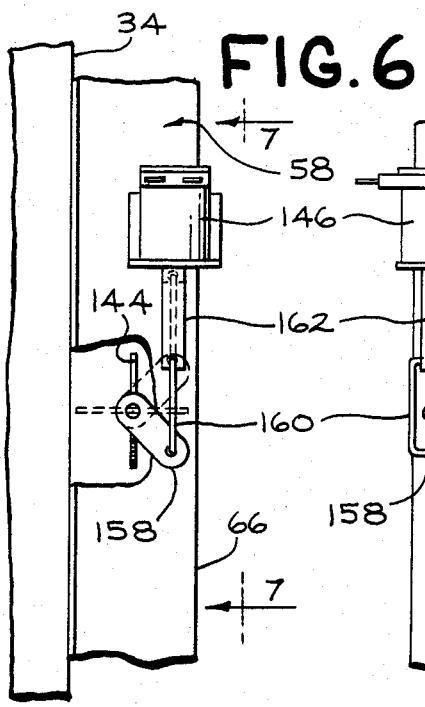
FIG. 6 is a partial enlarged view of the oven of FIG. 3 taken along lines 6—6 showing details of the means for introducing a discontinuity into the oven waveguide in accordance with the present invention.
Figure 7:
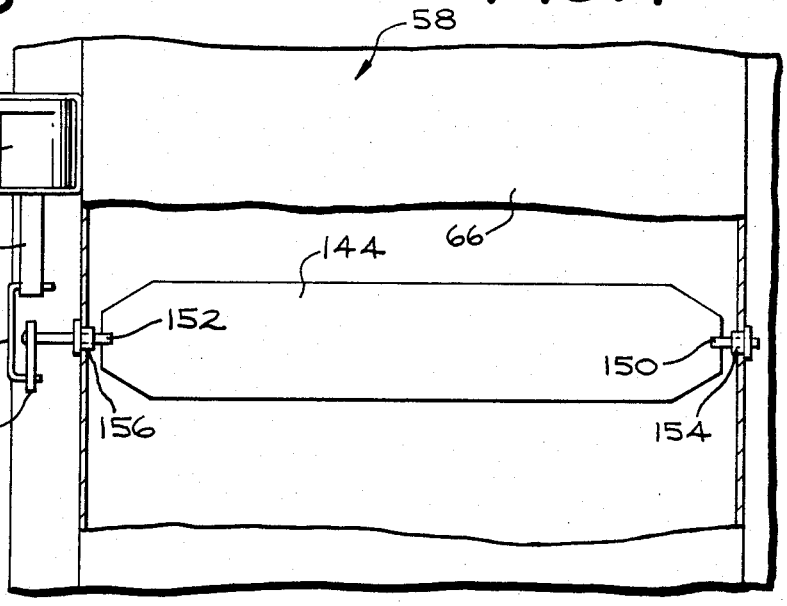
FIG. 7 is a partial enlarged view taken along lines 7—7 of FIG. 6 showing additional details of the means for introducing a discontinuity into the waveguide of the oven.

In the illustrative embodiment, as best seen in FIGS. 3, 6 and 7, the means for introducing a discontinuity into the waveguide comprises discontinuity plate 144 suitably secured in waveguide section 58 for movement between a neutral position in which the plane of plate 144 is essentially parallel to the longitudinal axis of the guide, i.e., parallel to the direction of propagation of energy in the guide; and an active position in which the plane of plate 144 is generally perpendicular to the longitudinal axis of the guide, transverse to the direction of energy propagation. In the neutral position, plate 144 has no substantial effect on energy propagation in the guide. In the active position plate 144 provides a short circuit termination for guide section 58. The position of plate 144 is controlled by short stroke low power solenoid 146 suitably mechanically linked to plate 144.

Plate 144 comprises a generally rectangular planar member formed of 20 gauge sheet metal, having a length slightly less than the width of guide section 58 to permit ample clearance and prevent arcing. Similarly, the width of the member 148 is slightly less than the height of guide section 58. The corners of the member are tapered to minimize potential arcing. Mounting pins 150 and 152 extend from opposite ends of plate member 148, through small apertures formed in opposing side walls of section 58, the longitudinal axes of said pins defining the axis of rotation of plate 144. Dielectric bushings 154 and 156 rotatably support pins 150 and 152, respectively, in the side wall apertures. Control arm 158 extends from pin 152 as part of the mechanical linkage to solenoid 146. Linking member 160 couples the free end of control arm 158 to solenoid plunger 162. FIG. 6 illustrates the neutral position for discontinuity 144 with solenoid plunger 162 extended in full lines. The active position for discontinuity 144 with plunger 162 withdrawn is illustrated in phantom.

When in its active position, discontinuity 144 effectively halts energization of slotted chamber 52, thereby altering the characteristics of the excitation system of oven 10 to the extent that, as hereinbefore described, the operating point on the Rieke diagram shifts to Region B when frozen objects are present in the cooking cavity.

The positioning of discontinuity 144 along the length of waveguide section 158 and the positioning of detector 120 along the length of waveguide section 56 interactively effect the performance of the defrost detection arrangement provided by the present invention. The position of discontinuity 144 is empirically selected at a location which forces a one-quarter guide wavelength shift in the phase of the standing wave in the guide section 56 when an object in its frozen state is being heated in cavity 26. Detector 120 is empirically positioned at a maximum field strength point for the frozen food load with discontinuity 144 in its active position. Hence, as the food approaches its thawed state, the operating point shifts from Region B to Region A, as the quarter wavelength phase shift decreases. As the phase shifts toward that for food in a thawed state, the voltage maximum point shifts away from detector 120. Hence, the transition from the frozen state to the thawed state may be detected by detecting a decrease in the field strength sensed by detector 120 below a suitably selected reference level. In the oven of FIG. 2, detector 120 is positioned approximately midway between antenna probe 86 and the entry port of guide section 56. Discontinuity plate 144 is located approximately midway between the entry port of guide section 58 and open end 70 of radiating chamber 52. The exact position for each is empirically determined by adjusting each to detect a maximum voltage or field strength at the detector location when the oven is operating in Region B of the Rieke diagram.

Figure 8:
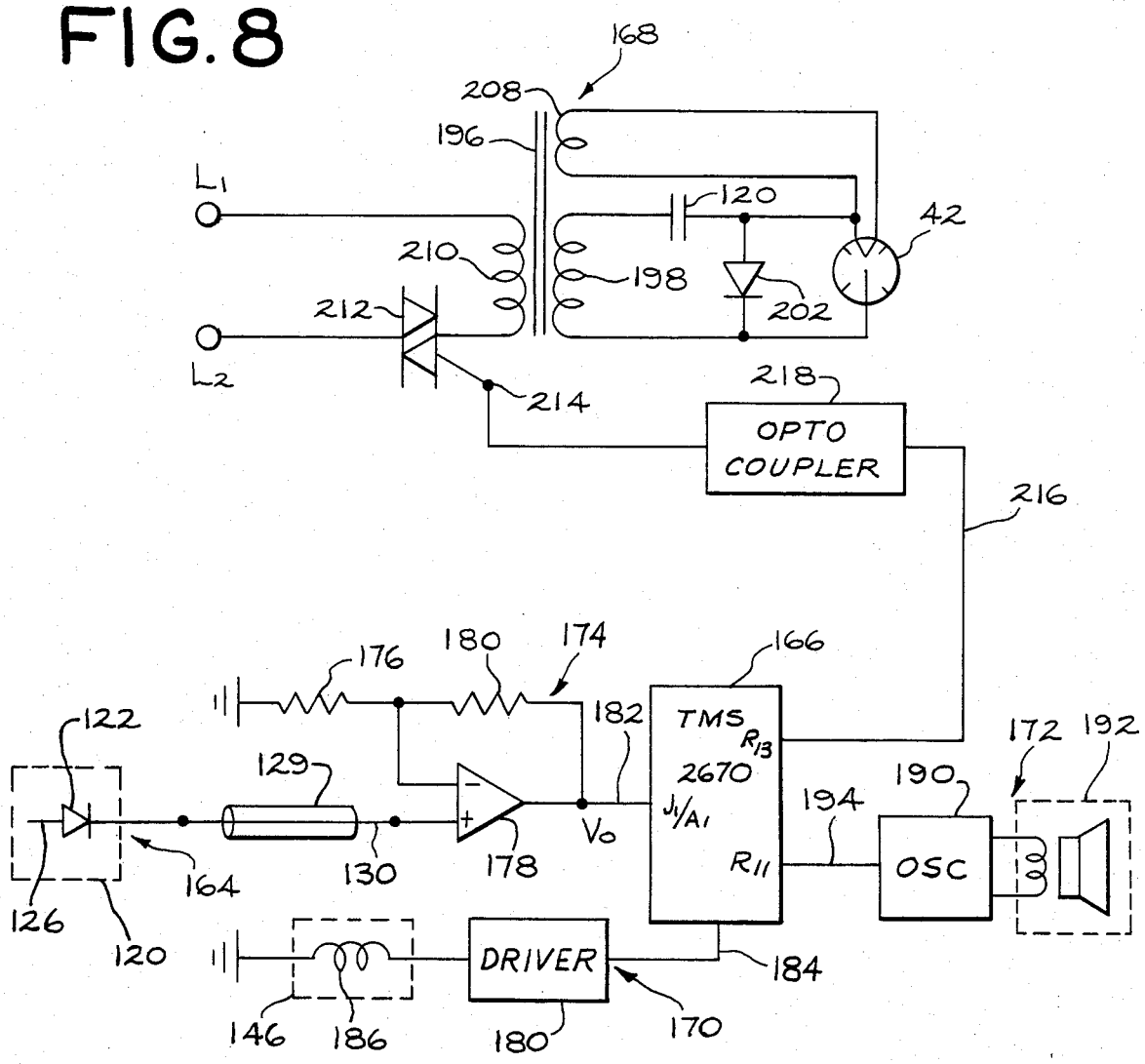
FIG. 8 is a simplified schematic circuit diagram of that portion of the microprocessor based control system of the oven of FIG. 1 illustratively embodying the present invention.

Referring now to the simplified schematic circuit diagram of FIG. 8, field detector 120 is incorporated in a microprocessor based control arrangement which illustratively embodies the apparatus and performs the method of the present invention. The circuit of FIG. 8 includes a field sensing circuit 164 for sensing the field strength of the electromagnetic field supported in the waveguide at detector 120 and generating a voltage signal having a magnitude representative of the sensed field strength; a microprocessor 166 for sampling and processing the voltage signal from sensing circuit 164 and controlling magnetron energization to implement a defrost mode algorithm; a magnetron power circuit 168; a solenoid circuit 170 responsive to microprocessor 166 to selectively position discontinuity member 144; and a user alert circuit 172 responsive to microprocessor 166 for providing an audible signal to the user signifying the end of the defrost mode.

Microprocessor 166 is a standard TMS 2670 Series 4K microprocessor of the type readily commercially available from Texas Instruments. The ROM of microprocessor 166 has been customized to perform the desired control functions for microwave oven 10.

Field sensing circuit 164 includes detector 120 which as hereinbefore described comprises probe 126 extending into waveguide section 58. Probe 126 is electrically connected to field sensitive crystal 122. The output signal from detector 120 may be on the order of millivolts. Hence, this signal is coupled to amplifying circuit 174 by suitably shielded coaxial cable 129. Amplifying circuit 174 includes a conventional operational amplifier 178 and a voltage divider network comprising resistors 176 and 180 which determine the gain of the amplifier network. The non-inverting input of amplifier 178 is coupled to inner conductor 130 from detector circuit 164. Resistor 180 is coupled between the output of conventional operational amplifier 178 and its inverting input. Resistor 176 is connected between the inverting input and ground. The values of resistors 176 and 180 are selected to provide the desired gain in accordance with standard circuit design practice. The amplified voltage signal $V_o$ which appears on line 182 is proportional to the sensed field strength at detector probe 126. $V_o$ is coupled to an appropriate input port of microprocessor 166 via line 182.

Microprocessor 166 is programmed to periodically generate a control signal effective to switch discontinuity member 144 into its active position for sampling periods of predetermined duration and to monitor the output signal provided by field sensing circuit 164 during these periods. A suitable sample control signal is coupled via line 184 from an output of microprocessor 166 to solenoid coil 186 of solenoid 146 via conventional driver circuit 180. When coil 186 is so energized, solenoid plunger 162 is retracted and discontinuity plate 144 is in its active position. In the illustrative embodiment, the frequency of the sampling interval is on the order of three samples per minute with a duration of the sampling period on the order of one second.

Detector monitoring means responsive to the voltage signal provided by field sensing circuit 164 on line 182 is provided in the circuit of FIG. 8 by microprocessor 166 which is appropriately programmed to detect a magnitude of $V_o$ indicative of a field strength less than a predetermined reference level. $V_o$ less than the reference level is indicative of the occurrence of the transition of the state of the food object in the cavity from its frozen state to its thawed state. The microprocessor is further programmed to control operation in the defrost mode in response to the detection of the voltage signal indicative of the transition being detected in a manner to be described hereinafter.

User alert circuit 172 comprises a conventional oscillator circuit 190 operative to drive speaker 192 at an audible frequency in response to a suitable control signal on line 194 from microprocessor 166. An audible tone is generated upon termination of the defrost mode to indicate to the user that the defrost cycle has ended.

Magnetron power circuit 168 is connected between lines L1 and L2 to provide power to magnetron 42. Lines L1 and L2 are adapted for coupling to a power supply such as that provided by a standard 120 volt 60 Hz domestic power receptacle. Power circuit 168 includes power transformer 196 having a high voltage secondary 198 connected to energize magnetron 42 through a half-wave voltage doubler circuit comprising series capacitor 200 and rectifying diode 202 connected across the magnetron anode and cathode terminals 204 and 206, respectively, and oppositely poled with respect thereto. Secondary winding 208 of transformer 196 is connected as a filament winding to heat the cathode of magnetron 42. Primary winding 210 of transformer 196 is connected across lines L1 and L2. Power to primary winding 210 is controlled by triac 212 connected in line L2. Gate terminal 214 of triac 212 is coupled to output line 216 to microprocessor 166 via conventional optocoupler circuit 218. Suitable control signals are provided to gate terminal 214 by microprocessor 166 to operate transformer 196 in a duty cycle control mode.

Figure 9A:
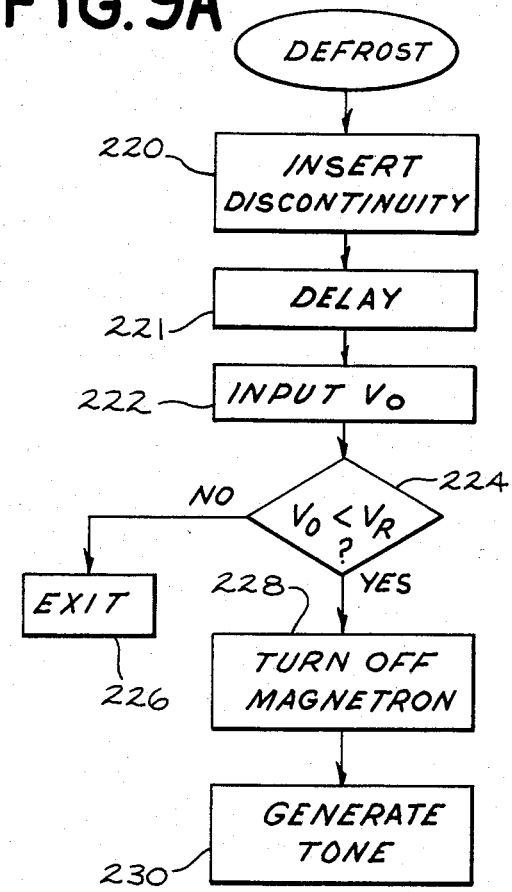
FIGS. 9A and 9B are flow diagrams illustratively embodying alternative defrost mode control algorithms implemented in the microprocessor in the circuit of FIG. 8 in accordance with one aspect of the present invention.
Figure 9B:
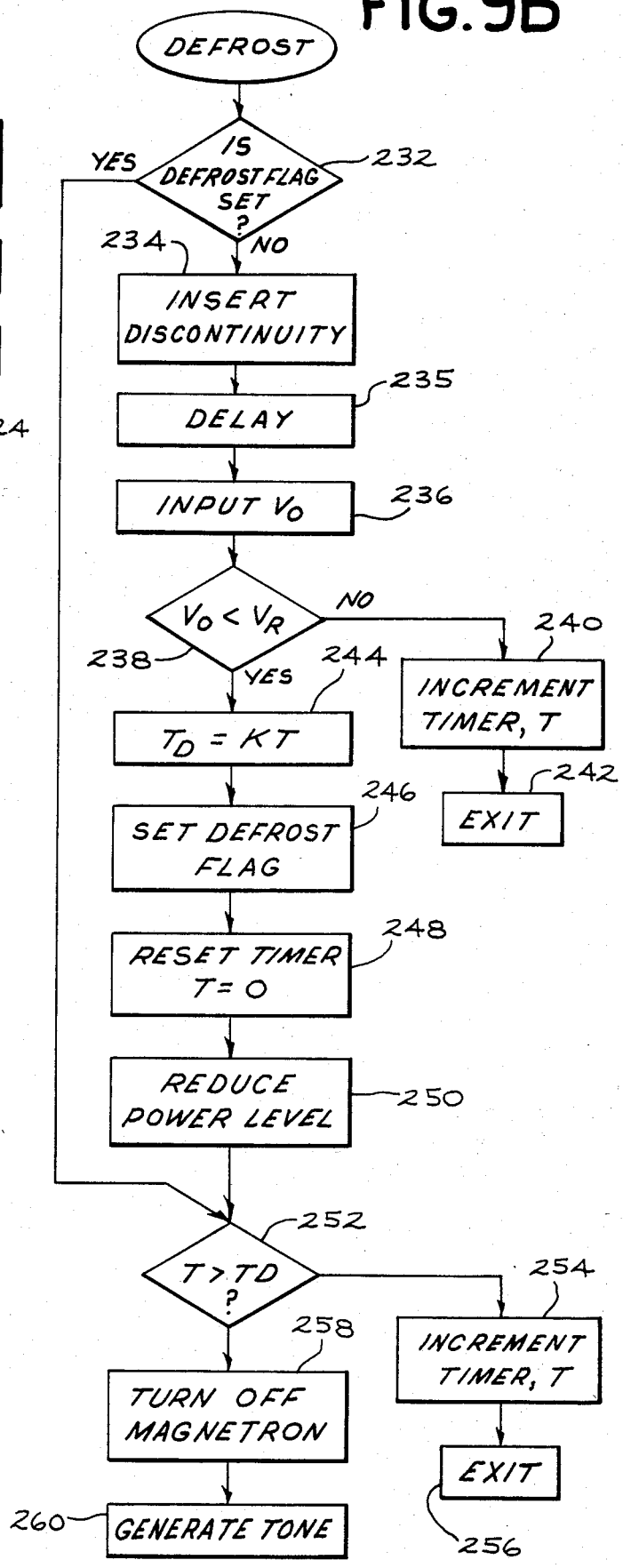

Operation of the circuit of FIG. 8 will now be described with reference to the flow diagrams of FIGS. 9A and 9B. FIGS. 9A and 9B illustrate alternative algorithms for controlling oven operation in the defrost mode in response to the field strength signal from field sensing circuit 164. These diagrams illustrate algorithms which can be implemented in the Read Only Memory (ROM) of microprocessor 166. From these diagrams, one of ordinary skill in the programming art can readily prepare a set of instructions for permanent storage in the ROM of microprocessor 166. It is of course to be understood that other portions of the microprocessor ROM may be utilized to implement additional oven control algorithms. Since the details of such additional algorithms add nothing to the understanding of the present invention, such details have been omitted for brevity and simplicity.

It will be recalled that the objective of defrost mode operation is to convert a food load from its frozen state to its thawed state while avoiding cooking the food. The algorithm of FIG. 9A simply turns off the magnetron, ending the defrost cycle, upon detection of an output voltage less than the predetermined reference signifying that the food load has assumed its thawed state.

Since frozen food items tend to thaw from the outside inwardly, this algorithm will work better for relatively thin food items which typically will be thawed to the center, when sufficiently thawed to cause the field strength voltage signal to drop below the reference level. However, for relatively thick or bulKy items such as roasts, surface thawing may progress to the point of causing the sought voltage decrease to occur even though the center region of the food item may not be thawed as completely as is preferable. The algorithm illustrated in FIG. 9B is applicable to a broader class of food loads. In this algorithm, the time required for the food load to become sufficiently thawed to cause the sought decrease in voltage to occur is measured. Upon detection of this condition, hereinafter referred to as the transition point, the operating power of the magnetron is reduced to avoid cooking the thawed regions but extends the cycle for an additional time period at a lower power setting to allow further thawing. The duration of this additional time period is determined as a function of the initial time period required to reach the thawed state. In this way, certain characteristics of the food load affecting the thawing time for the particular load are automatically taken into account.

Referring now to FIG. 9A, the first algorithm will be described in greater detail. This program will be entered periodically, according to the desired sampling rate. As hereinbefore described, in the illustrative embodiments the sampling rate is three samples per minute. Thus, this routine will be executed every twenty seconds when the oven is operated in the defrost mode. Upon entering the routine an output signal is provided on microprocessor output line 184, energizing solenoid 146, and causing discontinuity plate 144 to be placed in its active position (Block 220). After a suitable delay on the order of 500 milliseconds (Block 221) to allow conditions to stabilize, the voltage signal $V_o$ from field strength circuit 164 is read in (Block 222). An internal analog to digital conversion is performed by microprocessor 166, and Inquiry 224 determines whether the signal $V_o$ is less than reference voltage $V_R$. It will be recalled that reference voltage $V_R$ corresponds to a voltage level indicative of a typical food load in its thawed state. If the answer to Inquiry 224 is No, the microprocessor simply exits the defrost routine (Block 226). If the answer is Yes, signifying a load in its thawed state, the magnetron is turned off, ending the defrost cycle (Block 228), and a signal is provided on output line 194 (FIG. 8), enabling oscillator 190, thereby providing an audible signal (Block 230) to the user signifying the end of the defrost cycle.

Referring now to FIG. 9B, this routine is also periodically entered in accordance with the desired sampling rate, which in this embodiment is once every twenty seconds. Upon entering the routine, Inquiry 232 first checks the state of a defrost flag. If the transition point characterized by $V_o < V_R$ has not yet been reached, the answer to Inquiry 232 will be No, and the program continues by actuating the discontinuity (Block 234), after a suitable delay (Block 235) inputing $V_o$ (Block 236) and comparing $V_o$ with $V_R$ (Inquiry 238), as hereinbefore described with reference to FIG. 9A. If $V_o$ is not less than $V_R$, indicating the transition point has not yet been reached, timer T is incremented (Block 240) to measure the time required to reach the transition point. The program then exits the routine (Block 242). This sequence is repeated every twenty seconds until the answer to Inquiry 238 is Yes, signifying the transition point has been detected. At this point, T represents the time elapsed from the beginning of the defrost cycle to detection of the transition point. This value is multiplied by a constant K (Block 244) to compute the duration for the ensuing reduced power portion of the defrost cycle. The constant K is a predetermined factor empirically found to provide satisfactory results for the size and type of food loads to be defrosted. A factor in the 0.2–0.4 range is considered suitable for most food loads likely to be defrosted in a domestic microwave oven. As a further refinement of this algorithm, factors could be empirically determined for each of several categories of items to be defrosted, with the constant employed during any particular defrost cycle being selected by user input of food item category information when selecting the defrost cycle.

Next, the defrost flag is set (Block 246). The setting of the defrost flag enables the sampling portion of the defrost subroutine to be bypassed for the remaining portion of the defrost cycle by Inquiry 232. Timer T is reset (Block 248) to measure the duration of the remaining portion of the cycle. The power level for the magnetron is reduced to a lower level for the balance of the cycle to avoid surface cooking of the food item (Block 250). In the illustrative embodiment, the power level is set at approximately 30 percent of full power for the initial portion of the defrost cycle. The power level is reduced following detection of the transition point to a level in the 15–20 percent of full power range for the remainder of the defrost cycle. Inquiry 252 controls the duration of the second or final portion of the defrost cycle by comparing time T with $T_D$ the duration computed for the second portion of the cycle in Block 244. If the elapsed time T is less than $T_D$ (No to Inquiry 252), the timer is incremented (Block 254), and the program exits the subroutine (Block 256). When T is greater than $T_D$ (Yes to Inquiry 252), the magnetron is turned off, ending the defrost cycle (Block 258), and a signal is output to oscillator circuit 190 (FIG. 8) to generate an audible tone alerting the user that the defrost cycle has been completed (Block 260).

While specific embodiments of the method and apparatus of the present invention have been illustrated and described herein, it is realized that modifications and changes will occur to those skilled in the art to which the invention pertains. For example, the sensor location and the sampling circuitry are designed to respond to a decrease in field strength as the thawing of the food causes the phase of the standing wave in the waveguide to shift. Alternatively, by selecting a different sensor location, the system could be designed to detect a relative minimum field strength signal for the frozen state and a relative maximum field strength signal corresponding to the thawed state. It is therefore to be understood that the appended claims are intended to cover all such modifications and changes as fall within the true spirit and scope of the invention.

What is claimed is:

1. A microwave oven operable in a defrost mode in which objects in a frozen state are converted to a thawed state, said oven comprising:

a cooking cavity for heating objects received therein;

a source of microwave energy external of said cavity;

a waveguide for supporting an electromagnetic field therein to couple microwave energy from said source to said cavity;

sensing means for monitoring the field strength of said electromagnetic field supported in said waveguide at a predetermined location and generating a field strength signal indicative thereof;

means for periodically introducing an electromagnetic field discontinuity in said waveguide, said discontinuity being effective to substantially increase the difference in the phase and magnitude of the field in said waveguide when an object in its frozen state is being heated in said cavity relative to that for the object in its thawed state, thereby providing a readily detectable difference in sensed field strength at said predetermined location between that corresponding to the object in its frozen state and that corresponding to the object in its thawed state;

means for sampling said field strength signal when said electromagnetic field discontinuity is present in the waveguide to detect a signal indicative of the object being heated having assumed its thawed state; and means for controlling termination of the oven operation in the defrost mode in response to detection of said signal indicative of the object being heated having assumed its thawed state.

2. The defrost control arrangement of claim 1 wherein said sensing means comprises a voltage detector effective to generate a field strength signal corresponding to the magnitude of the sensed voltage at said predetermined location and wherein said means for introducing said electromagnetic field discontinuity is positioned and said predetermined location of said sensing means is selected such that with said discontinuity in said waveguide the voltage at said predetermined location is a relative maximum when the object being heated in said cavity is in its frozen state;

and said means for sampling includes means for detecting a sensed voltage less than a predetermined reference voltage indicative of the object being heated having assumed its thawed state.

3. A microwave oven operable in a defrost mode in which objects in a frozen state are heated until converted to a thawed state, said oven comprising:

a cooking cavity for receiving objects to be heated therein;

a source of microwave energy;

waveguide means for coupling microwave energy from said source to said cavity, said cavity waveguide and source being configured such that in normal operation the magnitude and phase of the electromagnetic field supported in said waveguide is substantially unchanged by the transition of an object being heated in said cavity from its frozen state to its thawed state;

sensing means for monitoring the field strength of the electromagnetic field supported in said waveguide at a predetermined location in the waveguide and generating a field strength signal indicative thereof;

means for periodically introducing an electromagnetic field discontinuity into said waveguide effective to substantially change the phase and magnitude of the electromagnetic field in the waveguide for an object in said cavity in its frozen state relative to that for the object in its thawed state, thereby providing a readily detectable difference in said field strength signal between the signals corresponding to the object in its frozen and thawed states, respectively;

means for sampling said field strength signal when said electromagnetic field discontinuity is present in said waveguide to detect a field strength signal indicative of the object having assumed its thawed state; and means for controlling oven operation in the defrost mode in response to detection of such a signal.

4. A microwave oven operable in a defrost mode to convert food objects from a frozen state to a thawed state, said microwave oven comprising:

a cooking cavity for heating objects received therein;

a source of microwave energy;

first radiating means for radiating energy into said cavity adjacent one wall of said cavity;

second radiating means for radiating energy into said cavity adjacent a second wall of said cavity., waveguide means for coupling energy from said source to said first and second radiating means, said waveguide means including first and second guide sections for coupling energy from said source to said first and second radiating means, respectively;

field strength detection means responsive to the field strength at a predetermined location in said first guide section operative to generate a field strength signal indicative of the field strength at said location, discontinuity means selectively movable between a neutral position having no significant effect on energy propagating in said waveguide means and an active position in said second guide section in which said discontinuity means is effective to substantially alter the phase and standing wave ratio of the standing wave supported in said waveguide means for an object in the cavity in its frozen state relative to the phase and standing wave ratio for the same object in its thawed state;

means for sampling said field strength signal when said discontinuity means is in its active position to detect a signal level indicative of the object having assumed its thawed state; and means for controlling oven operation in the defrost mode responsive to said sampling means.

5. The microwave oven of claim 4 wherein said second guide section comprises a hollow waveguide of rectangular cross section and wherein said discontinuity means comprises a conductive planar member mounted in said second guide section for rotation about an axis extending across said waveguide, said planar member being selectively rotatable between said neutral position in which said member lies in a plane extending generally parallel to the direction of propagation in said waveguide and said active position in which said member lies in a plane extending generally transverse to the direction of propagation.

6. The microwave oven of claim 5 wherein said field strength sensing means comprises a field crystal detector extending into the interior of said first guide section and said field strength signal is a voltage signal proportional to the field strength at said predetermined location along the length of said first guide section.

7. A method for defrosting objects in a microwave oven operable in a defrost cycle and having a cooking cavity for receiving objects to be heated therein, a source of microwave energy, and a waveguide coupling the microwave energy from the source to the cooking cavity, said method comprising the steps of:

(a) placing a frozen object in the cooking cavity;

(b) periodically introducing an electromagnetic field discontinuity into the waveguide for relatively short sampling periods, which discontinuity is effective to substantially increase the difference in the phase and magnitude of the electromagnetic field supported in the waveguide between the object in its frozen state and that for the object in its thawed state, relative to the difference which exists in the absence of the discontinuity;

(c) sampling the field strength of the electromagnetic field of the microwave energy in the waveguide at a predetermined location along the length of the waveguide to detect a field strength level indicative of the object assuming its thawed state;

(d) de-energizing the energy source, thereby terminating the defrost operating mode upon detection of the object assuming its thawed state.

8. A method for defrosting frozen objects in a microwave oven having a cooking cavity for receiving objects to be heated therein, a source of microwave energy and a waveguide comprising the steps of:

(a) operating the microwave energy source at a first power level;

(b) periodically introducing an electromagnetic field discontinuity is effective to substantially increase the change in the phase and magnitude of the electromagnetic field support in the waveguide for an object in its frozen state being heated in the cavity relative to that object in its thawed state;

(c) sampling the field strength of the electromagnetic field in the waveguide during each sampling period to detect a field strength level indicative of the object assuming its thawed state;

(d) measuring a first time period from the beginning of the defrost cycle to the first detection of a field strength level indicative of the object assuming its thawed state;

(e) reducing the output power level of the microwave source to a second relatively lower power level upon such detection;

(f) operating the oven at the second power level for a second time period of a duration calculated as a function of the first time period;

(g) terminating oven operation at the end of the second time period.

* * * * *

UNITED STATES PATENT AND TRADEMARK OFFICE

CERTIFICATE OF CORRECTION

PATENT NO. : 4,507,530

DATED : March 26, 1985

INVENTOR(S) : Peter H. Smith

It is certified that error appears in the above-identified patent and that said Letters Patent is hereby corrected as shown below:

Column 16, line 58, after "discontinuity" insert --into the waveguide for relatively short sampling periods, which discontinuity--.

Column 16, line 60, "support" should read --supported--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*